US009410106B2

(12) United States Patent
Kiko et al.

(10) Patent No.: US 9,410,106 B2
(45) Date of Patent: Aug. 9, 2016

(54) LUBRICATING OIL COMPOSITION

(71) Applicant: IDEMITSU KOSAN CO., LTD., Chiyoda-ku (JP)

(72) Inventors: Yumiko Kiko, Ichihara (JP); Tahei Okada, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/384,837

(22) PCT Filed: Mar. 11, 2013

(86) PCT No.: PCT/JP2013/056556
§ 371 (c)(1),
(2) Date: Sep. 12, 2014

(87) PCT Pub. No.: WO2013/137160
PCT Pub. Date: Sep. 19, 2013

(65) Prior Publication Data

US 2015/0051128 A1 Feb. 19, 2015

(30) Foreign Application Priority Data

Mar. 12, 2012 (JP) ..... 2012-055140

(51) Int. Cl.

| | |
|---|---|
| ***C10M 141/00*** | (2006.01) |
| ***C10M 141/10*** | (2006.01) |
| ***C10M 169/04*** | (2006.01) |
| *C10M 133/56* | (2006.01) |
| *C10M 135/20* | (2006.01) |
| *C10M 137/04* | (2006.01) |
| *C10M 137/10* | (2006.01) |
| *C10M 101/02* | (2006.01) |

(Continued)

(52) U.S. Cl.

CPC ..... *C10M 141/10* (2013.01); *C10M 169/04* (2013.01); *C10M 101/02* (2013.01); *C10M 117/02* (2013.01); *C10M 133/16* (2013.01); *C10M 133/56* (2013.01); *C10M 135/20* (2013.01); *C10M 137/04* (2013.01); *C10M 137/10* (2013.01); *C10M 2203/1025* (2013.01); *C10M 2205/0285* (2013.01); *C10M 2207/026* (2013.01); *C10M 2207/34* (2013.01); *C10M 2215/064* (2013.01); *C10M 2215/08* (2013.01); *C10M 2215/223* (2013.01); *C10M 2215/28* (2013.01); *C10M 2219/022* (2013.01); *C10M 2219/083* (2013.01); *C10M 2219/085* (2013.01); *C10M 2219/106* (2013.01); *C10M 2223/041* (2013.01); *C10M 2223/043* (2013.01); *C10M 2223/047* (2013.01); *C10N 2220/022* (2013.01); *C10N 2230/04* (2013.01); *C10N 2230/06* (2013.01); *C10N 2230/08* (2013.01); *C10N 2230/12* (2013.01); *C10N 2230/26* (2013.01); *C10N 2230/36* (2013.01); *C10N 2240/08* (2013.01)

(58) Field of Classification Search

CPC ..... C10M 141/10; C10M 169/04; C10M 133/56; C10M 135/20; C10M 2203/1025; C10N 2220/022

See application file for complete search history.

(56) References Cited

U.S. PATENT DOCUMENTS 5,094,763 A 3/1992 Tochigi et al.
7,723,276 B2 * 5/2010 Yokota et al. ..... 508/463

(Continued)

FOREIGN PATENT DOCUMENTS

CN 1319126 A 10/2001
EP 0 382 242 A1 8/1990

(Continued)

OTHER PUBLICATIONS

International Search Report issued May 7, 2013, in PCT/JP13/056556, filed Mar. 11, 2013.

(Continued)

*Primary Examiner* — Cephia D Toomer
(74) *Attorney, Agent, or Firm* — Oblon, McClelland, Maier & Neustadt, L.L.P.

(57) ABSTRACT

A lubricating oil composition containing a base oil having a kinematic viscosity at 40 degrees C. in a range from 10 $mm^2/s$ to 1000 $mm^2/s$ with: (A) at least one of phosphorus compounds represented by a formula (1) in an amount of 0.001 mass % to 0.3 mass % in terms of a phosphorus content; (B) at least one of a sulfur compound represented by a formula (2) and a sulfur compound that comprises a dithio (—S—S—) bond in a molecule in an amount of 0.01 mass % to 0.5 mass % in terms of a sulfur content, the latter sulfur compound, when added to the base oil in an amount of 1 mass %, leading to a rating of 2 or lower in a copper strip corrosion test; and (D) a succinimide derivative in an amount of 0.01 mass % to 1 mass %.

(1)

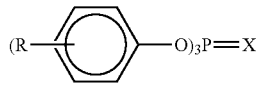

(2)

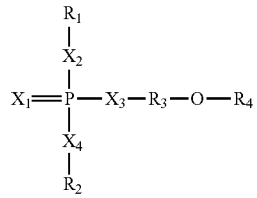

20 Claims, No Drawings

(51) Int. Cl.
*C10M 117/02* (2006.01)
*C10M 133/16* (2006.01)

(56) References Cited

U.S. PATENT DOCUMENTS

| | | | | |
|---|---|---|---|---|
| 2002/0010103 | A1* | 1/2002 | Takayama et al. | 508/433 |
| 2004/0138073 | A1 | 7/2004 | Karol et al. | |
| 2009/0318316 | A1 | 12/2009 | Morishima | |
| 2012/0172266 | A1 | 7/2012 | Kasai et al. | |

FOREIGN PATENT DOCUMENTS

| | | |
|---|---|---|
| JP | 02-212596 | 8/1990 |
| JP | 2003-171684 | 6/2003 |
| JP | 2003-278640 | 10/2003 |
| JP | 2006-502287 | 1/2006 |
| JP | 2008-069234 | 3/2008 |
| JP | 2008-115301 | 5/2008 |
| JP | 2011-063654 | 3/2011 |
| JP | 2011-140607 | 7/2011 |

OTHER PUBLICATIONS

Shadan Hojin Nippon Junkatsu Gakkai, Junkatsu Handbook, 3rd edtion, Kabushiki Kaisha Yokendo, table 3.1.44, (3 pages) Jun. 1, 1975.

Osada, I., "Mitsubishi Jukogyo no Furyoku Hatsuden-Yojo Fusha eno Torikumi-", Furyoku Energy, vol. 35, No. 1, fig. 7, (4 pages), 2011.

U.S. Appl. No. 14/413,309, filed Jan. 7, 2015, Kiko.

Combined Chinese Office Action and Search Report issued Aug. 11, 2015 in Patent Application No. 201380013124.7 (with English language translation and English translation of categories of cited documents).

Extended European Search Report issued Oct. 26, 2015 in Patent Application No. 13760927.7.

* cited by examiner

LUBRICATING OIL COMPOSITION

CROSS REFERENCE TO RELATED APPLICATIONS

The present application is a 35 U.S.C. §371 national stage patent application of International patent application PCT/JP2013/056556, filed on Mar. 11, 2013, published as WO/2013/137160 on Sep. 19, 2013, the text of which is incorporated by reference, and claims the benefit of the filing date of Japanese application no. 2012-055140, filed on Mar. 12, 2012, the text of which is also incorporated by reference.

TECHNICAL FIELD

The present invention relates to a lubricating oil composition. In particular, the present invention relates to a lubricating oil composition for hydraulic equipment usable in industrial machines such as construction machines, machine tools, processing machines for plastics, mining machines and wind-power/hydroelectric generators.

BACKGROUND ART

A pressure produced by hydraulic equipment has been increased every year, so that troubles such as scuffing of a hydraulic pump have frequently been caused. Therefore, ISO standards have required an FZG scuffing test. FZG scuffing resistance is usually improved by adding an acid phosphate or an amine salt thereof or, alternatively, an active sulfur compound (see, for instance, Patent Literature 1). Patent Literature 1 suggests a lubricating oil composition prepared by blending a base oil with (a) phosphate in an amount of 0.01 to 5 mass %, (b) an amine salt of an acid phosphate in an amount of 0.005 to 1 mass % and (c) a sulfuric extreme pressure agent in an amount of 0.01 to 1 mass %. However, since an oil temperature is raised with an increased pressure produced by hydraulic equipment, these additives may unfavorably turn to sludge. The sludge causes filter clogging, valve lockout and pump wear. Further, an amine salt of an acid phosphate and an alkenyl succinate, which is used as a general rust inhibitor, tend to lower the pH of eluted water, so that polyurethane rubber is likely to deteriorate under the presence of water.

A suggested composition that contains neither an amine salt of an acid phosphate nor an alkenyl succinate is, for instance, a hydraulic oil composition prepared by blending a base oil with (A) phosphate or thiophosphate in an amount of 150 to 3000 mass ppm in terms of a phosphorus content, (B) a sulfur compound having a dithio bond in a molecule in an amount of 0.02 to 0.5 mass % in terms of a sulfur content, (C) a metal sulfonate in an amount of 0.05 to 5 mass %, and (D) an overbased metal salicylate or an overbased metal phenate in an amount of 0.01 to 0.5 mass % (see Patent Literature 2).

CITATION LIST

Patent Literatures

Patent Literature 1: JP-A-2003-171684
Patent Literature 2: JP-A-2011-140607

SUMMARY OF THE INVENTION

Problems to be Solved by the Invention

Even the composition disclosed in Patent Literature 2 is not always satisfactory in all the aspects such as wear resistance, low-sludge properties and prevention of rubber deterioration. Further, even though a lubricating oil to be used for hydraulic equipment should have a rust-preventing effect, a lubricating oil composition satisfactory in all of these four properties has not been suggested.

An object of the invention is to provide a lubricating oil composition that: provides excellent wear resistance (e.g., scuffing resistance); suppresses the generation of sludge; prevents the deterioration of a rubber seal member; and is excellent in a rust-preventing effect.

Means for Solving the Problems

In order to solve the above problems, an aspect of the invention provides the following lubricating oil composition.

[1] A lubricating oil composition contains:

a base oil having a kinematic viscosity at 40 degrees C. in a range from 10 $mm^2/s$ to 1000 $mm^2/s$;

(A) at least one of phosphorus compounds represented by a formula (1) below in an amount of 0.001 mass % to 0.3 mass % in terms of a phosphorus content, Formula 1

(1)

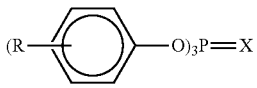

in which: R is a hydrogen atom or an alkyl group having 3 or more carbon atoms; and X is an oxygen atom or a sulfur atom;

(B) at least one of a sulfur compound (B-1) represented by a formula (2) below and a sulfur compound (B-2) having a dithio (—S—S—) bond in a molecule in an amount of 0.01 mass % to 0.5 mass % in terms of a sulfur content, the sulfur compound (B-2), when added to the base oil in an amount of 1 mass %, leading to a rating of 2 or lower in a copper strip corrosion test (JIS K 2513, measurement conditions: at 100 degrees C. for three hours), Formula 2

(2)

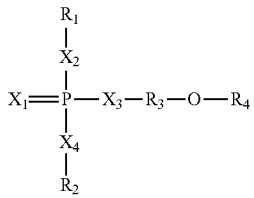

in which: $R_1$, $R_2$ and $R_4$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms; $R_3$ is a linear or branched alkylene group having 1 to 6 carbon atoms; and $X_2$, $X_3$ and $X_4$ are each independently an oxygen atom or a sulfur atom and $X_1$ is an oxygen atom or a sulfur atom with the proviso that the formula (2) has at least one sulfur atom; and (D) a succinimide derivative in an amount of 0.01 mass % to 1 mass %.

[2] The lubricating oil composition further contains (C) a carboxylic acid amide with an acid number of 10 mg KOH/g or less in an amount of 0.01 mass % to 0.5 mass %.

[3] The lubricating oil composition further contains (C') a carboxylic acid amide in such an amount that pH of eluted water according to JIS Z 8802 becomes in a range from 6 to 8.

[4] In the lubricating oil composition, the component (B-2) contains a sulfur compound having a polythio bond not smaller than a trithio (—S—S—S—) bond in an amount of 1 mass % or less of a total amount of the component (B-2).

[5] In the lubricating oil composition, the component (D) contains an alkyl group or an alkenyl group in a side chain, the side chain having a number average molecular weight in a range from 500 to 3000.

[6] In the lubricating oil composition, the base oil is a base oil categorized into Group II or Group III of base oil categories according to API.

[7] In the lubricating oil composition, the base oil is a poly-alpha-olefin (PAO).

[8] In the lubricating oil composition, an acid number of the lubricating oil composition is in a range from 0.01 mg KOH/g to 0.05 mg KOH/g.

[9] A hydraulic oil contains the lubricating oil composition.

[10] A hydraulic oil for a hydraulic drive train used in a wind power generator contains the lubricating oil composition.

The above aspect of the invention can provide a lubricating oil composition that: provides excellent wear resistance (e.g., scuffing resistance); exhibits favorable heat resistance to suppress the generation of sludge; prevents the deterioration of a rubber seal member (e.g., packing); and is excellent in a rust-preventing effect.

DESCRIPTION OF EMBODIMENT(S)

According to an exemplary embodiment of the invention, a lubricating oil composition is prepared by blending a base oil with (A) a specific phosphorus compound, (B) a specific sulfur compound and (D) a succinimide derivative and, preferably, the base oil is further blended with a component (C) or (C'). A detailed description is as follows.

Base Oil

The base oil usable for the lubricating oil composition according to the exemplary embodiment (hereinafter, also simply referred to as "the present composition") is subject to no particular limitation, but is preferably an oil having a kinematic viscosity at 40 degrees C. in a range from 10 $mm^2/s$ to 1000 $mm^2/s$. When the kinematic viscosity at 40 degrees C. is not less than 10 $mm^2/s$, evaporation loss is small. When the kinematic viscosity at 40 degrees C. is not more than 1000 $mm^2/s$, an excessive power loss due to viscosity resistance can be avoided. More preferably, the kinematic viscosity at 40 degrees C. is in a range from 10 $mm^2/s$ to 460 $mm^2/s$.

The base oil preferably has a viscosity index of 80 or more. When the viscosity index is 80 or more, a change in viscosity with temperature is small, so that the base oil can maintain a necessary viscosity at a high temperature. The viscosity index is more preferably 100 or more and further more preferably 120 or more. The base oil preferably has a saturated content of 90 mass % or more. When the saturated content is 90 mass % or more, the present composition exhibits an improved oxidation stability. The saturated content is more preferably 95 mass % or more and further more preferably 97 mass % or more. A sulfur content in the base oil is preferably 0.03 mass % or less. When the sulfur content in the base oil is 0.03 mass % or less, the present composition exhibits an improved oxidation stability. Incidentally, the sulfur content is a value measured according to JIS K 2541 and the saturated content is a value measured according to ASTM D 2007.

Further, the pour point of the base oil is preferably minus 10 degrees C. or less. When the pour point is minus 10 degrees C. or less, the present composition exhibits a sufficient fluidity even at a low temperature. The pour point is more preferably minus 15 degrees C. or less, further more preferably minus 20 degrees C. or less, and particularly preferably minus 25 degrees C. or less.

As the base oil used in the present composition, one of base oils categorized into Group II, III or IV of the base oil categories according to American Petroleum Institute (API) or a mixture of two or more thereof is favorably usable. Base oils of Group II have a viscosity index in a range from 80 to 120, a sulfur content of 0.03 mass % or less and a saturated content of 90 mass % or more. Base oils of Group III have a viscosity index of 120 or more, a sulfur content of 0.03 mass % or less and a saturated content of 90 mass % or more. Base oils of Group IV are poly-alpha-olefin (PAO).

The base oil may be a mineral oil or a synthetic oil as long as the base oil has the above properties. The mineral oil or the synthetic oil is subject to no particular limitation in type or others. Examples of the mineral oils are paraffin-based mineral oils, intermediate-based mineral oils and naphthene-based mineral oils that are prepared by purifying processes such as solvent purification, hydrogenation purification and hydrocracking.

Examples of the synthetic oil are poly-alpha-olefin (PAO), alpha-olefin-copolymer, polybutene, alkylbenzene, polyol ester, dibasic acid ester, polyoxy alkylene glycol, polyoxy alkylene glycol ester, polyoxy alkylene glycol ether, hindered ester and silicone oil. Further, isomerized products of slack wax and GTL WAX are also usable.

Among the above examples, mineral oils prepared by hydrogenation purification, mineral oils prepared by hydrocracking, isomerized products of slack wax and GTL WAX (i.e., wax-isomerized mineral oils) and poly-alpha-olefin are favorably usable. Especially, a base oil categorized into Group II of the base oil categories according to API or poly-alpha-olefin (PAO) is preferably useable as the base oil of the present composition in terms of easy-availability.

According to the exemplary embodiment, one of the above mineral oils may be singularly used or a combination of two or more thereof may be used as the base oil. Alternatively, one of the above synthetic oils may be singularly used or a combination of two or more thereof may be used. Further alternatively, a combination of at least one of the above mineral oils and at least one of the above synthetic oils may be used.

Component (A)

The phosphorus compound usable as the component (A) of the present composition is triaryl phosphate or triaryl thiophosphate represented by the following formula (1).

Formula 3

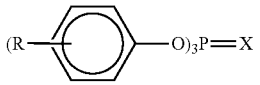

(1)

In the formula (1), R is a hydrogen atom or an alkyl group having 3 or less carbon atoms and X is an oxygen atom or a sulfur atom. In the formula (1), three R may be mutually the same or different. Examples of the alkyl group having 3 or less carbon atoms are a methyl group, ethyl group, n-propyl group and isopropyl group.

The phosphorus compound represented by the formula (1) preferably has an acid number of 10 mg KOH/g or less. When the acid number is 10 mg KOH/g or less, the resulting lubricating oil composition exhibits excellent heat resistance and the generation of sludge can be suppressed. The acid number is more preferably 5 mg KOH/g or less and further more preferably 1 mg KOH/g or less. Incidentally, the acid number is a value measured according to JIS K 2501.

Examples of the phosphorus compound represented by the formula (1) are triphenyl phosphate, tricresyl phosphate, triphenyl thiophosphate and tricresyl thiophosphate. In particular, tricresyl phosphate and triphenyl phosphorothioate are preferable.

In the present composition, one of the above phosphorus compounds listed as the component (A) may be singularly used or a combination of two or more thereof may be used. The blending amount of the component (A) is in a range from 0.001 mass % to 0.3 mass % of the total amount of the composition in terms of a phosphorus content. When the phosphorus content is less than 0.001 mass %, wear resistance is insufficient. On the other hand, when the phosphorus content exceeds 0.3 mass %, the effect is not so improved as expected from such an amount, which is economically unfavorable. Further, phosphorus is likely to deposit at a low temperature. The phosphorus content is more preferably in a range from 0.01 mass % to 0.1 mass %.

Component (B)

The sulfur compound usable as the component (B) of the present composition is: a thiophosphate compound (B-1) represented by the following formula (2); or a sulfur compound (B-2) that has a dithio (—S—S—) bond in a molecule and, when added to the base oil in an amount of 1 mass %, leads to a rating of 2 or lower in a copper strip corrosion test (JIS K 2513, measurement conditions: at 100 degrees C. for three hours).

Formula 4

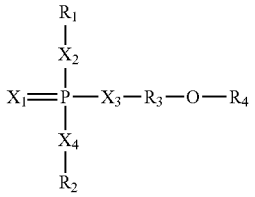

(2)

In the sulfur compound (B-1) represented by the formula (2), $R_1$, $R_2$ and $R_4$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms. $R_3$ is a linear or branched alkylene group having 1 to 6 carbon atoms. $X_2$, $X_3$ and $X_4$ are each independently an oxygen atom or a sulfur atom. $X_1$ is an oxygen atom or a sulfur atom. In the formula (2), at least one sulfur atom is contained.

The above sulfur compound, which contains a sulfur atom and a phosphorus atom in a molecule, contributes to improving wear resistance (e.g., scuffing resistance). Specific examples are a thiophosphate compound and a dithiophosphate compound.

Examples of the thiophosphate compound are tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propylphenyl) phosphorothionate, tris(isopropylphenyl) phosphorothionate, tris(n-butylphenyl) phosphorothionate, tris(isobutylphenyl) phosphorothionate, tris(s-butylphenyl) phosphorothionate and tris(t-butylphenyl) phosphorothionate.

Examples of the dithiophosphate compound are dihexyl dithiophosphate, dioctyl dithiophosphate, di(2-ethylhexyl) dithiophosphate, didodecyl dithiophosphate, dihexadecyl dithiophosphate, di(hexylthioethyl)dithiophosphate, di(octylthioethyl)dithiophosphate, di(dodecylthioethyl)dithiophosphate, di(hexadecylthioethyl)dithiophosphate, dioctanyl dithiophosphate, dioleyl dithiophosphate, dicyclohexyl dithiophosphate, diphenyl dithiophosphate, ditolyl dithiophosphate, dibenzyl dithiophosphate, diphenethyl dithiophosphate and ethyl-3-[{bis(1-methylethoxy) phosphinothioyl}thio]propionate.

In terms of the effects of the invention, the dithiophosphate compound is more preferable than the thiophosphate compound.

As the component (B-2) (i.e., the sulfur compound), a sulfur compound having a dithio (—S—S—) bond in a molecule is usable. The sulfur compound having a dithio (—S—S—) bond contributes to improving the wear resistance (e.g., scuffing resistance) of the present composition.

The component (B-2) (i.e., the sulfur compound), which has a dithio (—S—S—) bond in a molecule, preferably contains a sulfur compound having a polythio bond (not smaller than a trithio (—S—S—S—)) in an amount of 1 mass % or less of the total amount of the sulfur compound having the dithio bond and the sulfur compound having the polythio bond. When the sulfur compound contains the sulfur compound having a polythio bond not smaller than a trithio (—S—S—S—) bond in an amount of 1 mass % or less, the heat resistance of the composition can be enhanced to suppress the generation of sludge.

The component (B-2) (i.e., the sulfur compound) is preferably a sulfur compound that leads to a rating of 2 or lower in a copper strip corrosion test (measurement conditions: at 100 degrees C. for three hours) according to JIS K 2513. With the sulfur compound that leads to a rating of 2 or less in the copper strip corrosion test, the hydraulic oil composition can exhibit favorable heat resistance to suppress the generation of sludge. More preferably, the sulfur compound leads to a rating of 1 in the copper strip corrosion test.

Preferable examples of the sulfur compound having a dithio (—S—S—) bond (i.e., the component (B-2)) in the present composition are (b-1) bis(alkyldithio)-thiadiazole, (b-2) dialkyl dithioglycolate, (b-3) dihydrocarbyl disulfide and (b-4) tetraalkyl thiuram disulfide. Specific examples of (b-1) thiadiazole, are 2,5-bis(1,1,3,3-tetramethylbutanedithio)-1,3,4-thiadiazole, 2,5-bis(t-octyldithio)-1,3,4-thiadiazole, 2,5-bis(n-nonyldithio)-1,3,4-thiadiazole and 2,5-bis(n-dodecyldithio)-1,3,4-thiadiazole. Specific examples of (b-2) dialkyl dithioglycolate are diethyl dithioglycolate, di-n-butyl dithioglycolate, di-iso-butyl dithioglycolate, di-n-octyl dithioglycolate, di-iso-octyl dithioglycolate, di(2-ethylhexyl)dithioglycolate, didecyl dithioglycolate, diundecyl dithioglycolate, ditetradecyl dithioglycolate and dioctadecyl dithioglycolate. Examples of (b-3) dihydrocarbyl disulfide are di-tert-butyl disulfide, dioctyl disulfide, di-tert-nonyl disulfide, didodecyl disulfide, dibenzyl disulfide, diphenyl disulfide and dicyclohexyl disulfide. Examples of (b-4) tetraalkyl thiuram disulfide are tetramethyl thiuram disulfide and tetraethyl thiuram disulfide.

According to the exemplary embodiment, (b-2) dialkyl dithioglycolate and (b-3) dihydrocarbyl disulfide are preferable in terms of the effects. Specifically, di-n-butyl dithioglycolate, di-iso-butyl dithioglycolate and dibenzyl disulfide are preferable.

In the present composition, one of the above sulfur compounds listed as the component (B) may be singularly used or a combination of two or more thereof may be used.

The blending amount of the component (B) is preferably in a range from 0.01 mass % to 0.5 mass % of the total amount of the composition in terms of a sulfur content. When the blending amount is less than 0.01 mass %, a wear-preventing effect (extreme-pressure properties) may be insufficient. On the other hand, when the blending amount exceeds 0.5 mass %, the effect may not be so improved as expected from such an amount. The blending amount is more preferably in a range from 0.02 mass % to 0.2 mass %.

Component (C)

The component (C) of the present composition is preferably a carboxylic acid amide having an acid number of 10 mg KOH/g or less. When the acid number is more than 10 mg KOH/g, a rust-preventing effect is improved but sludge is likely to be generated to lower the pH of eluted water due to a poor heat resistance, so that polyurethane rubber is likely to deteriorate under the presence of water.

The above carboxylic acid amide can be prepared by reacting amine (ammonia) with a carboxylic acid, examples of which are a caproic acid, caprylic acid, capric acid, lauric acid, myristic acid, palmitic acid, stearic acid, arachidic acid, behenic acid, lignoceric acid, zoomaric acid, oleic acid, linoleic acid, linolenic acid, gadoleic acid, erucic acid, selacholeic acid, ricinoleic acid and hydroxystearic acid.

As the carboxylic acid amide, a carboxylic acid alkanolamide is also favorably usable. Examples of the carboxylic acid alkanolamide are a lauric acid diethanolamide, oleic acid diethanolamide, stearic acid diethanolamide, oleic acid monoethanolamide, oleic acid monopropanolamide and oleic acid dipropanolamide.

For the present composition, oleic acid diethanolamide is especially favorably usable as the carboxylic acid amide in terms of rust-preventing effect and solubility.

In the present composition, one of the above carboxylic acid amides listed as the component (C) may be singularly used or a combination of two or more thereof may be used.

The blending amount of the component (C) is in a range from 0.01 mass % to 0.5 mass %. When the blending amount is less than 0.01 mass %, the present composition may not exhibit a rust-preventing effect. On the other hand, when the blending amount is more than 0.5 mass %, sludge is likely to be generated due to a poor heat resistance.

Component (C')

In the present composition, a carboxylic acid amide may be blended as the component (C') in such an amount that the pH of eluted water according to JIS Z 8802 becomes in a range from 6 to 8. When the pH of the eluted water based on the present composition falls within the range from 6 to 8, the deterioration of polyurethane rubber, which is used in hydraulic equipment or the like as a material of packing seal/coating or the like, is suppressed, thereby maintaining favorable sealing performance.

Component (D)

According to the exemplary embodiment, a succinimide derivative is used as the component (D). This component contributes to preventing rust and dispersing sludge. As the succinimide derivative, a succinimide having an alkyl group or an alkenyl group in a side chain, which is known as an ashless dispersant, is favorably usable. In particular, a succinimide with a side chain that has an alkyl group or an alkenyl group and has a number average molecular weight approximately in a range from 500 to 3000 is preferable. When the number average molecular weight of the side chain is less than 500, the succinimide is likely to be less dispersible in the base oil. On the other hand, when the number average molecular weight of the side chain is more than 3000, the succinimide is difficult to handle in preparation of the lubricating oil composition. Further, the viscosity of the composition is excessively increased, so that, for instance, the composition may deteriorate the operating characteristics of hydraulic equipment or the like where the composition is used.

There are a variety of examples of the succinimide, which include a succinimide having a polybutenyl group or a polyisobutenyl group. The polybutenyl group is provided by polymerizing a mixture of 1-butene and isobutene or a highly pure isobutene or by hydrogenating a polyisobutenyl group. Incidentally, the succinimide may be either a so-called monoalkenyl/alkyl succinimide or a so-called bis-alkenyl/alkyl succinimide. Among the above examples, a polybutenyl succinimide is preferable.

The succinimide derivative may be further modified with boron in use. For instance, a boron-modified polybutenyl succinimide may be provided by adding an organic solvent such as alcohols, hexane and xylene with the above polyamine, a polybutenyl succinic acid (anhydride) and a boron compound such as a boric acid and heating the mixture under appropriate conditions. Incidentally, examples of the boron compound may include boric anhydride, halogenated boron, borate, amide borate and boron oxide in addition to a boric acid. Among the above, a boric acid is particularly preferable.

When the boron-modified succinimide is blended, a boron content is preferably in a range from 50 mass ppm to 3000 mass ppm of the total amount of the composition and more preferably in a range from 50 mass ppm to 2500 mass ppm. When the boron content is 50 mass ppm or more, the heat resistance of the resulting lubricating oil composition is improved. Further, it is favorable that the boron content is 3000 mass ppm or less because hydrolysis of a boron part can be suppressed and production costs can be saved. The boron content in such a boron derivative is subject to no particular limitation but is usually in a range from 0.05 mass % to 5 mass % and preferably in a range from 0.1 mass % to 3 mass %.

The blending amount of the component (D) is preferably in a range from 0.01 mass % to 1 mass % of the total amount of the composition and more preferably in a range from 0.05 mass % to 0.5 mass %. When the blending amount is less than 0.01 mass %, the effect of the component (D) is unlikely to be obtained. However, when the blending amount exceeds 1 mass %, the effect is not so improved as expected from such an amount. Further, when the blending amount is excessively large, water-separability is likely to be lowered. Incidentally, one of the above examples may be singularly used or a combination of two or more thereof may be used as the component (D) as long as the blending amount of the component (D) falls within the above range.

The present composition can be prepared by blending the base oil with the component (A), the component (B) and the component (D) and more preferably by blending the base oil with the component (C) or the component (C') in addition to the components (A), (B) and (D). Further, in order to improve the performance of the present composition, known additives such as a metal detergent, antioxidant, metal deactivator, viscosity index improver, pour point depressant and antifoaming agent may be blended as needed as long as an object of the invention is achieved.

Examples of a favorable combination of the component (A), the component (B), the component (C) and the component (D) are: (I) tricresyl phosphate (component (A)), dithiophosphate compound (component (B)), oleic acid diethanolamide (component (C)) and polybutenyl succinimide (component (D)); (II) triphenyl phosphorothioate (component (A)), dithiophosphate compound (component (B)), oleic acid diethanolamide (component (C)) and polybutenyl succinimide (component (D)); (III) triphenyl phosphorothioate (component (A)), dibutyl dithioglycolate (component (B)), oleic acid diethanolamide (component (C)) and polybutenyl succinimide (component (D)); and (IV) triphenyl phosphorothioate (component (A)), dibenzyl disulfide (component (B)), oleic acid diethanolamide (component (C)) and polybutenyl succinimide (component (D)).

Preferable examples of the metal detergent are metal sulfonate, metal salicylate and metal phenate. These substances not only enhance the rust-preventing effect of the lubricating oil composition, but also contribute to suppressing a decrease in the pH of water that is present/mixed in the lubricating oil and thus to suppressing the deterioration of a packing seal material such as polyurethane rubber. The metal sulfonate may be neutral, basic or overbased. Among the above examples, a neutral alkaline earth metal sulfonate is preferable and a neutral Ca sulfonate is especially preferable. The metal salicylate and the metal phenate are preferably used in the forms of an overbased metal salicylate and an overbased metal phenate, respectively. Any of these metal detergents is preferably blended in an amount from 0.05 mass % to 0.5 mass % of the total amount of the composition.

Examples of the antioxidant are a phenolic antioxidant and an amine antioxidant. One of these antioxidants may be singularly used and a combination of two or more thereof may be used. Examples of the phenolic antioxidant are monophenolic compounds such as 2,6-di-tert-butyl-4-methyl phenol, 2,6-di-tert-butyl-4-ethyl phenol and octadecyl 3-(3.5-di-tert-butyl-4-hydroxyphenyl)propionate and diphenolic compounds such as 4,4'-methylenebis(2,6-di-tert-butylphenol) and 2,2'-methylenebis(4-ethyl-6-tert-butylphenol).

Examples of the amine antioxidant are: monoalkyldiphenylamine compounds such as monooctyldiphenylamine and monononyldiphenylamine; dialkyldiphenylamine compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine compounds such as tetrabutyldiphenylamine, tetrahexyldiphenylamine, tetraoctyldiphenylamine and tetranonyldiphenylamine; and naphthylamine compounds such as alpha-naphthylamine, phenyl-alpha-naphthylamine, butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine and nonylphenyl-alpha-naphthylamine.

According to the exemplary embodiment, one of the above phenolic antioxidants may be singularly used or a combination of two or more thereof may be used. Similarly, one of the above amine antioxidants may be singularly used or a combination of two or more thereof may be used. Further, one or more of the above phenolic antioxidants and one or more of the above amine antioxidants are preferably used in combination. According to the exemplary embodiment, the blending amount of the antioxidant is preferably in a range from 0.05 mass % to 2 mass %, more preferably in a range from 0.1 mass % to 1 mass %, of the total amount of the composition.

Examples of the metal deactivator are benzotriazole and thiadiazole. The blending amount of these metal deactivators is preferably approximately in a range from 0.005 mass % to 1 mass %, more preferably in a range from 0.007 mass % to 0.5 mass %, of the total amount of the composition.

Examples of the viscosity index improver are polymethacrylate, dispersed polymethacrylate, an olefin copolymer (e.g., an ethylene-propylene copolymer), a dispersed olefin copolymer and a styrene copolymer (e.g., a styrene-diene copolymer). The blending amount of the viscosity index improver is subject to no particular limitation but is preferably in a range from 0.5 mass % to 15 mass %, more preferably in a range from 1 mass % to 10 mass %, of the total amount of the composition.

An example of the pour point depressant is polymethacrylate with a mass average molecular weight approximately in a range from 50,000 to 150,000. The blending amount of the pour point depressant is preferably in a range from 0.1 mass % to 5 mass %, more preferably in a range from 0.2 mass % to 2 mass %, of the total amount of the composition.

Examples of the antifoaming agent are a polymeric-silicone antifoaming agent and a polyacrylate antifoaming agent. The blending amount of the antifoaming agent is preferably in a range from 0.0001 mass % to 0.5 mass %, more preferably in a range from 0.0005 mass % to 0.3 mass %, of the total amount of the composition.

The pH of eluted water based on the present composition as formulated as described above is preferably in a range from 6 to 8. When the pH of the eluted water based on the present composition falls within the range from 6 to 8, the deterioration of polyurethane rubber, which is used in hydraulic equipment or the like as a material of packing seal/coating or the like, is suppressed, thereby maintaining favorable sealing performance.

The acid number (mg KOH/g) of the composition, which is a value measured by an electrical potential technique according to "Determination of Lubricant Neutralization Number" as defined by JIS K2501, is preferably in a range from 0.01 mg KOH/g to 0.05 mg KOH/g and more preferably in a range from 0.02 mg KOH/g to 0.04 mg KOH/g.

The present composition provides excellent wear resistance (e.g., scuffing resistance); exhibits favorable heat resistance to suppress the generation of sludge; prevents the deterioration of a polyurethane rubber seal member (e.g., packing); and is excellent in a rust-preventing effect. Therefore, the present composition is favorably usable as a lubricating oil in a variety of applications. Especially, the present composition is favorably usable as a hydraulic oil for construction machines, injection molding machines, machine tools, iron-making equipment and the like, and also works well as a hydraulic oil for the other hydraulic equipment such as industrial robots and hydraulic elevators. In particular, in view of the fact that a lubricating oil is generally difficult to replace, the present composition is favorably usable as a hydraulic oil for a hydraulic drive train in a wind power generator and a hydraulic oil for a wind power generator equipped with a hydraulic drive train because such hydraulic oils are required to have a longer lifetime.

EXAMPLES

Next, the present invention will be further described in detail based on Examples, which by no means limit the invention. Incidentally, the performance was evaluated by the following methods.

(1) Wear Resistance (FZG Scuffing Resistance Test)

A load was gradually increased using an FZG gear test rig based on the conditions according to DIN 51354-2 and a load stage where scuffing was caused was taken as wear resistance.

(2) Rust Preventing Effect (Rust-Prevention Test)

Measurement was performed according to JIS K 2510 (method B, artificial seawater method).

(3) Eluted Water pH

A sample oil and ion-exchange water were mixed in a mass ratio of 1:1 and left still, and then the pH of water was measured (JIS Z 8802).

(4) Heat Resistance (Sludge Amount after Oxidation Test)

Based on a test for determining the oxidation stability of a lubricating oil for an internal combustion engine (ISOT) according to JIS K 2514-1996, generated sludge was collected by a millipore filter and the amount of the sludge (mg/100 mL) was measured. A test temperature was 150 degrees C. and a test time was 168 hours.

(5) Rubber-Deterioration Prevention (Polyurethane-Rubber-Immersion Test)

90 mL of a sample oil and 10 mL of ion-exchange water were poured into a glass beaker and JIS3 dumbbell made of polyurethane rubber (specified by JCMAS P041) was immersed therein. An immersion test was then performed at 93 degrees C. for 120 hours while the mixture was stirred. The tensile strength of the immersed polyurethane rubber dumbbell was measured and a tensile strength change rate (%) relative to the tensile strength of polyurethane rubber measured before the immersion test was calculated.

Examples 1 to 5 and Comparative Examples 1 to 6

As shown in Table 1, sample oils of Examples and Comparative Examples were prepared by blending base oils with a variety of additives and the performance of each oil was evaluated. The results are shown in Table 1.

TABLE 1

| | | Ex. 1 | Ex. 2 | Ex. 3 | Ex. 4 | Ex. 5 | Comp. 1 |
|---|---|---|---|---|---|---|---|
| Base Oil | | Residual | Residual | Residual | Residual | Residual | Residual |
| Phosphorus Compound 1 (Component (A)) | (mass %) | 0.40 | — | — | — | — | — |
| Phosphorus Compound 2 (Component (A)) | (mass %) | — | 0.10 | 0.10 | 0.10 | 0.50 | 0.50 |
| Phosphorus Compound 3 | (mass %) | — | — | — | — | — | — |
| Sulfur Compound 1 (Component (B-1)) | (mass %) | 0.20 | 0.20 | 0.20 | — | — | — |
| Sulfur Compound 2 (Component (B-2)) | (mass %) | — | — | — | — | 0.50 | 0.50 |
| Sulfur Compound 3 (Component (B-2)) | (mass %) | — | — | — | 0.50 | — | — |
| Sulfur Compound 4 (Component (B-2)) | (mass %) | — | — | — | — | — | — |
| Sulfur Compound 5 | (mass %) | — | — | — | — | — | — |
| Carboxylic Acid Amide 1 (Component (C)) | (mass %) | 0.05 | 0.05 | 0.05 | 0.05 | 0.05 | — |
| Carboxylic Acid Amide 2 | (mass %) | — | — | — | — | — | 0.05 |
| Alkenyl succinimide (Component (D)) | (mass %) | 0.10 | 0.10 | 0.10 | 0.10 | 0.10 | 0.10 |
| Alkenyl succinate | (mass %) | — | — | — | — | — | — |
| Phenolic Antioxidant | (mass %) | 0.15 | 0.15 | 0.15 | 0.15 | 0.15 | 0.15 |
| Amine Antioxidant | (mass %) | 0.15 | 0.15 | 0.15 | 0.15 | 0.15 | 0.15 |
| Metal Deactivator | (mass %) | 0.05 | 0.05 | 0.05 | 0.05 | 0.05 | 0.05 |
| Antifoaming Agent | (mass %) | 0.10 | 0.10 | 0.10 | 0.10 | 0.10 | 0.10 |
| Kinematic Viscosity at 40° C. ($mm^2/s$) | | 45.59 | 45.88 | 45.59 | 45.59 | 45.72 | 44.9 |
| Acid Number (mg KOH/g) | | 0.04 | 0.02 | 0.04 | 0.04 | 0.04 | 0.07 |
| P-content (mass ppm) | | 350 | 230 | 233 | 230 | 348 | 350 |
| S-content (mass ppm) | | 434 | 435 | 434 | 1000 | 1600 | 1600 |
| FZG Scuffing Resistance Test (fail stage) | | 10 | 10 | 10 | 10 | 10 | 10 |
| Rust Preventing Effect (artificial seawater) | | Not rusted | Not rusted | Not rusted | Not rusted | Not rusted | Not rusted |
| Eluted Water pH | | 6.2 | 6.4 | 6.1 | 6.6 | 6.7 | 5.2 |
| Heat Resistance (sludge amount) (mg/100 mL) | | 0.3 | 0.1 | 0.1 | 0.1 | 0.1 | 0.1 |
| Rubber-deterioration Prevention (change in tensile strength) (%) | | 2 | −2 | 2 | −1 | −5 | −65 |

| | | Comp. 2 | Comp. 3 | Comp. 4 | Comp. 5 | Comp. 6 |
|---|---|---|---|---|---|---|
| Base Oil | | Residual | Residual | Residual | Residual | Residual |
| Phosphorus Compound 1 (Component (A)) | (mass %) | 0.80 | 0.40 | 0.40 | 0.80 | 0.40 |
| Phosphorus Compound 2 (Component (A)) | (mass %) | — | — | — | — | — |
| Phosphorus Compound 3 | (mass %) | 0.02 | 0.02 | 0.02 | — | — |
| Sulfur Compound 1 (Component (B-1)) | (mass %) | — | — | — | — | — |
| Sulfur Compound 2 (Component (B-2)) | (mass %) | — | — | — | — | — |
| Sulfur Compound 3 (Component (B-2)) | (mass %) | — | — | — | — | — |
| Sulfur Compound 4 (Component (B-2)) | (mass %) | 0.06 | — | — | — | 0.15 |
| Sulfur Compound 5 | (mass %) | — | 0.06 | 0.06 | — | — |
| Carboxylic Acid Amide 1 (Component (C)) | (mass %) | — | — | — | — | — |
| Carboxylic Acid Amide 2 | (mass %) | — | — | — | — | — |
| Alkenyl succinimide (Component (D)) | (mass %) | — | — | 0.10 | — | — |
| Alkenyl succinate | (mass %) | 0.05 | 0.05 | 0.05 | 0.05 | — |
| Phenolic Antioxidant | (mass %) | 0.15 | 0.15 | 0.15 | 0.15 | 0.15 |
| Amine Antioxidant | (mass %) | 0.15 | 0.15 | 0.15 | 0.15 | 0.15 |
| Metal Deactivator | (mass %) | 0.05 | 0.05 | 0.05 | 0.05 | 0.05 |
| Antifoaming Agent | (mass %) | 0.10 | 0.10 | 0.10 | 0.10 | 0.10 |
| Kinematic Viscosity at 40° C. ($mm^2/s$) | | 46.15 | 46.12 | 46.12 | 45.62 | 45.32 |
| Acid Number (mg KOH/g) | | 0.15 | 0.14 | 0.14 | 0.17 | 0.17 |
| P-content (mass ppm) | | 667 | 363 | 363 | 562 | 332 |
| S-content (mass ppm) | | 221 | 227 | 227 | 606 | 610 |
| FZG Scuffing Resistance Test (fail stage) | | 12 | 11 | 11 | 8 | 11 |

TABLE 1-continued

| | | | | | |
|---|---|---|---|---|---|
| Rust Preventing Effect (artificial seawater) | Not rusted | Not rusted | Not rusted | Not rusted | Rusted |
| Eluted Water pH | 5.6 | 5.7 | 5.7 | 8.2 | 5.9 |
| Heat Resistance (sludge amount) (mg/100 mL) | 4.0 | 55.0 | 5.0 | 0.3 | 8.5 |
| Rubber-deterioration Prevention (change in tensile strength) (%) | −65 | −72 | −70 | −64 | −45 |

1) Base oil: hydrorefined mineral oil categorized into Group II of the API categories, kinematic viscosity at 40 degrees C.: 46 $mm^2/s$
2) Phosphorus compound 1 (component (A)): tricresyl phosphate
3) Phosphorus compound 2 (component (A)): triphenyl phosphorothioate
4) Phosphorus compound 3: amine salt of acid phosphate (VANLUBE672 manufactured by Vanderbilt Chemicals, LLC)
5) Sulfur compound 1 (component (B-1)): dithiophosphate compound (IRGALUBE63 manufactured by Ciba Specialty Chemicals Corporation)
6) Sulfur compound 2 (component (B-2)): dibenzil disulfide (copper strip corrosion test 1 (1b))
7) Sulfur compound 3 (component (B-2)): dibutyl dithioglycolate (copper strip corrosion test 2 (2C))
8) Sulfur compound 4 (component (B-2)): 2,5-bis(n-dodecyldithio)-1,3,4-thiadiazole (copper strip corrosion test 1 (1A))
9) Sulfur compound 5: olefin-sulfide-containing sulfur compound (HITEC343 manufactured by Afton Chemical Corporation)
10) Carboxylic acid amide 1 (component (C)): oleic acid diethanolamide (acid number: 0.6 mg KOH/g)
11) Carboxylic acid amide 2: higher alkyl-substituted dodecylene succinamide (acid number: 60 mg KOH/g)
12) Alkenyl succinimide (component (D)): polybutenyl succinimide (LZ6406 manufactured by The Lublizol Corporation)
13) Alkenyl succinate: LZ859 manufactured by The Lublizol Corporation (alkenyl succinic acid multivalent alcohol ester)
14) Phenolic antioxidant: 2,6-di-t-butyl-p-cresol
15) Amine antioxidant: diphenylamine (IRGANOX-L57 manufactured by Ciba Specialty Chemicals Corporation)
16) Metal deactivator: benzotriazole-based (IRGAMET39 manufactured by Ciba Specialty Chemicals Corporation)
17) Antifoaming agent: 889D manufactured by The Lublizol Corporation
18) Kinematic viscosity at 40 degrees C.: measured according to JIS K 2283
19) Acid number: measured by an electrical potential technique according to "Determination of Lubricant Neutralization Number" as defined by JIS K2501
20) P-content: measured according to JPI-5S-38-92
21) S-content: measured according to JIS K 2541

Evaluation Results

As is understood from Table 1, the sample oils of Examples 1 to 5 exhibit favorable wear resistance (FZG scuffing resistance), heat resistance (the generated amount of sludge) and rust-preventing effect and are excellent in preventing the deterioration of polyurethane rubber.

In contrast, Comparative Examples 1 to 6, which lack some of the compositional elements according to the exemplary embodiment, are inferior in performance to Examples 1 to 5.

The invention claimed is:

1. A lubricating oil composition comprising:

a base oil having a kinematic viscosity at 40 degrees C. in a range from 10 $mm^2/s$ to 1000 $mm^2/s$;

(A) a phosphorus compound represented by a formula (1) in an amount of 0.001 mass % to 0.3 mass % in terms of a phosphorus content,

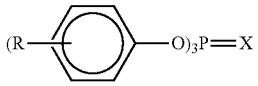

(1)

where: R is a hydrogen atom or an alkyl group having 3 or less carbon atoms; and X is an oxygen atom or a sulfur atom;

(B) at least one sulfur compound selected from the group consisting of a thiophosphate compound, a dithiophosphate compound and a sulfur compound (B-2) comprising a dithio (—S—S—) bond in a molecule in an amount of 0.01 mass % to 0.5 mass % in terms of a sulfur content, the sulfur compound (B-2), when added to the base oil in an amount of 1 mass %, leading to a rating of 2 or lower in a copper strip corrosion test under JIS K 2513, at 100 degrees C. for three hours, (C) a carboxylic acid amide with an acid number of 10 mg KOH/g or less in an amount of 0.01 mass % to 0.5 mass %; and (D) a succinimide derivative in an amount of 0.01 mass % to 1 mass %, wherein an acid number of the lubricating oil composition is in a range from 0.01 mg KOH/g to 0.05 mg KOH/g.

2. The lubricating oil composition according to claim 1, wherein said composition comprises said sulfur compound (B-2) comprising a polythio bond not smaller than a trithio (—S—S—S—) bond in an amount of 1 mass % or less of a total amount of the sulfur compound (B-2).

3. The lubricating oil composition according to claim 1, wherein the succinimide derivative (D) comprises an alkyl group or an alkenyl group in a side chain, the side chain having a number average molecular weight in a range from 500 to 3000.

4. The lubricating oil composition according to claim 1, wherein the base oil comprises a base oil categorized into Group II or Group III of base oil categories according to API.

5. The lubricating oil composition according to claim 1, wherein the base oil comprises a poly-alpha-olefin (PAO).

6. The lubricating oil composition according to claim 1, wherein an acid number of the lubricating oil composition is in a range from 0.02 mg KOH/g to 0.04 mg KOH/g.

7. A hydraulic oil comprising the lubricating oil composition according to claim 1.

8. A hydraulic oil suitable for a hydraulic drive train used in a wind power generator, the hydraulic oil comprising the lubricating oil composition according to claim 7.

9. The lubricating oil composition according to claim 1, comprising the thiophosphate compound.

10. The lubricating oil composition according to claim 1, comprising the dithiophosphate compound.

11. The lubricating oil composition according to claim 1, comprising the sulfur compound (B-2).

12. A lubricating oil composition comprising:

a base oil having a kinematic viscosity at 40 degrees C. in a range from 10 $mm^2/s$ to 1000 $mm^2/s$;

(A) a phosphorus compound represented by a formula (1) in an amount of 0.001 mass % to 0.3 mass % in terms of a phosphorus content, (1)

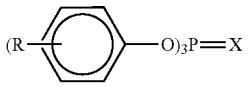

where: R is a hydrogen atom or an alkyl group having 3 or less carbon atoms; and X is an oxygen atom or a sulfur atom;

(B) at least one sulfur compound selected from the group consisting of a thiophosphate compound, a dithiophosphate compound and a sulfur compound (B-2) comprising a dithio (—S—S—) bond in a molecule in an amount of 0.01 mass % to 0.5 mass % in terms of a sulfur content, the sulfur compound (B-2), when added to the base oil in an amount of 1 mass %, leading to a rating of 2 or lower in a copper strip corrosion test under JIS K 2513, at 100 degrees C. for three hours, and (D) a succinimide derivative in an amount of 0.01 mass % to 1 mass %, said composition further comprising (C') a carboxylic acid amide in such an amount that a pH of eluted water according to JIS Z 8802 is in a range from 6 to 8, and wherein an acid number of the lubricating oil composition is in a range from 0.01 mg KOH/g to 0.05 mg KOH/g.

13. The lubricating oil composition according to claim 12, further comprising (C) a carboxylic acid amide with an acid number of 10 mg KOH/g or less in an amount of 0.01 mass % to 0.5 mass %.

14. The lubricating oil composition according to claim 12, wherein said composition comprises said sulfur compound (B-2) comprising a polythio bond not smaller than a trithio (—S—S—S—) bond in an amount of 1 mass % or less of a total amount of the sulfur compound (B-2).

15. The lubricating oil composition according to claim 12, wherein the succinimide derivative (D) comprises an alkyl group or an alkenyl group in a side chain, the side chain having a number average molecular weight in a range from 500 to 3000.

16. The lubricating oil composition according to claim 12, wherein the base oil comprises a base oil categorized into Group II or Group III of base oil categories according to API.

17. The lubricating oil composition according to claim 12, wherein the base oil comprises a poly-alpha-olefin (PAO).

18. The lubricating oil composition according to claim 12, comprising the thiophosphate compound.

19. The lubricating oil composition according to claim 12, comprising the dithiophosphate compound.

20. The lubricating oil composition according to claim 12, comprising the sulfur compound (B-2).

* * * * *